US008276235B2

(12) United States Patent
Naughton

(10) Patent No.: US 8,276,235 B2
(45) Date of Patent: Oct. 2, 2012

(54) WEARABLE WIPE UNIT

(76) Inventor: Daniel P. Naughton, San Diego, CA (US)

( * ) Notice: Subject to any disclaimer, the term of this patent is extended or adjusted under 35 U.S.C. 154(b) by 929 days.

(21) Appl. No.: 12/106,410

(22) Filed: Apr. 21, 2008

(65) Prior Publication Data

US 2008/0190975 A1 Aug. 14, 2008

Related U.S. Application Data

(63) Continuation-in-part of application No. 11/097,573, filed on Apr. 1, 2005, now abandoned.

(51) Int. Cl.
*A47L 25/00* (2006.01)

(52) U.S. Cl. ..... 15/209.1; 15/118; 224/194; 224/932; 24/3.12; 24/306; 24/555

(58) Field of Classification Search ..... 15/118, 15/209.1, 264, 3.11, 3.12; 24/3.11–3.12, 24/555, 545, 546, 563, 304, 306, 910; 224/194, 224/252, 663, 667, 932, 933
See application file for complete search history.

(56) References Cited

U.S. PATENT DOCUMENTS 3,279,009 A * 10/1966 Deane ..... 24/3.6
4,413,379 A * 11/1983 Evans ..... 24/3.11
4,741,074 A * 5/1988 Budano et al. ..... 24/3.11
D302,629 S * 8/1989 Luckritz ..... D3/221
4,866,213 A * 9/1989 Lindsay ..... 174/354
4,953,770 A * 9/1990 Bond, Sr. ..... 224/250
5,143,371 A * 9/1992 Strahan ..... 473/285
5,147,703 A * 9/1992 Provost et al. ..... 428/82
5,295,278 A * 3/1994 Condon et al. ..... 15/104.04
5,381,922 A * 1/1995 Gladman et al. ..... 220/481
5,797,142 A * 8/1998 Debronsky et al. ..... 2/69
5,860,191 A * 1/1999 Sieger ..... 24/3.3
5,913,618 A * 6/1999 Yosha ..... 40/658
6,038,742 A * 3/2000 Patterson ..... 24/3.12
6,052,936 A * 4/2000 Garcia ..... 43/4
6,058,580 A * 5/2000 Shih ..... 24/511
6,148,464 A * 11/2000 Shioda ..... 15/118
6,199,733 B1 * 3/2001 Reynolds, III ..... 224/269
6,199,736 B1 * 3/2001 Musarella et al. ..... 224/667
6,226,827 B1 * 5/2001 English, Jr. ..... 15/118
6,418,595 B1 * 7/2002 Shih ..... 24/536
6,427,293 B1 * 8/2002 Bowes, Jr. ..... 24/304
6,457,218 B1 * 10/2002 Lawrence ..... 24/563
6,688,505 B1 * 2/2004 Bradley et al. ..... 224/230
6,705,497 B1 * 3/2004 Schuett ..... 224/247
6,981,298 B2 * 1/2006 Isoda et al. ..... 24/3.12
7,216,788 B2 * 5/2007 Blechman ..... 224/162
7,607,627 B1 * 10/2009 Mchatet ..... 248/316.7
7,926,149 B2 * 4/2011 Weston ..... 24/3.12
7,963,010 B2 * 6/2011 Levesque ..... 24/545
2002/0083542 A1 * 7/2002 Hart ..... 15/210.1
2006/0277705 A1 * 12/2006 Kohlruss et al. ..... 15/209.1
2008/0190975 A1 * 8/2008 Naughton ..... 224/269

* cited by examiner

*Primary Examiner* — Mark Spisich
*Assistant Examiner* — Michael Jennings
(74) *Attorney, Agent, or Firm* — Steins & Associates, P.C.

(57) ABSTRACT

A wearable wipe unit having one or more absorbent members attachable to, and removable from, a retaining member, or each other. The retaining member has a mouth which attaches to a user's waist band or belt. One or more absorbent members may have a storage unit for securely holding a user's personal effects. The bottoms of the front and back sides of the retaining member are angled forward for ease of attachment.

5 Claims, 5 Drawing Sheets

WEARABLE WIPE UNIT

CROSS REFERENCES TO RELATED APPLICATIONS

This application is a continuation-in-part of nonprovisional application, application Ser. No. 11/097,573, filed on Apr. 1, 2005, now abandoned.

STATEMENT REGARDING FEDERALLY-SPONSORED RESEARCH OR DEVELOPMENT

None.

BACKGROUND

This invention relates to a wearable absorbent material, referred to herein as a wipe. More specifically to a wipe which can be repeatedly removed from where worn, used, and replaced for future use. Another embodiment encompasses the wearing of more than one wipe, each of which are individually removable, useable, and then discardable.

The dawn of health consciousness has brought a wave of physical-fitness related products to aid the health-conscious individual. Exercise devices, exercise clothing, and exercise accessories have saturated the market and have been a boon to all who are interested in exercise to maintain good health. Many exercisers have found aerobics to suit their circulatory, respiratory, muscular, and general health needs. A variety of exercise garments are used for aerobics ranging from home-created cut-off pants and jersey, to custom-made and fitted tights.

Heavy aerobic exercise, heavy lifting, and routine cardio-exercise, however, leads to heavy perspiration. Equipment and facilities used by such exercisers, when touched, leaves residue or traces of the user's perspiration. Most gym and exercise facilities requires all patrons to wipe all equipment after use of touching to prevent contamination or cross-contamination.

Many other sporting and hobby activities would benefit from a wearable wipe unit, such as, but not limited to, hiking, fishing, boating, skiing, jogging, walking, aerobics, basketball, baseball, football, in-line skating, biking, rock climbing, soccer, tennis, bowling, and golf.

Many times perspiration falls into the eyes of joggers while they are running and having no available means of wiping the perspiration from their brow they use their shirts (if they have them on). A wearable wiper unit conveniently located on their shorts would let them remove the annoying perspiration from their eyes without even having to stop. Fishermen constantly have to bate their hooks, handle wet fish, and remove slime that accumulates on their line. A common practice is to wear jeans and wipe their hands off on their pants. Fishermen would welcome a readily available towel to wipe their poles and hands.

Miss hits and bad shots occur in tennis because the participant loses their grip on account of perspiration getting on their hands. In between points, tennis players often wipe their racquet hand on their shorts to get a better grip. At the end of the game, their shorts are dirty and stained with the racquet grip residue from wiping their hands on their shorts. Having a removable towel to clean their hands would help them play better and save their wardrobe.

It is very important for rock climbers to have both hands free while having quick and easy access to a towel to wipe the moisture from their hands and face. This allows them to have a firmer grip and better vision while performing their dangerous climbs. The wearable wiper unit will fulfill this necessity.

Many professions also have a need for a readily available wiping towel or rag, be it made of cloth, synthetic material, paper, or any combinations thereof, so that the user may wipe equipment or tools or one's hands. Such professions in need of a readily available wiping towel, rag, or wipe include, but are not limited to, waitresses, mechanics, maids, chefs, nurses, manufacturing machine-operators, dental assistants, and bartenders.

For example when clearing off tables waitresses complain of not having enough hands to do their job. Having to carry, dishes, silverware, and menus, along with other items forces them to have to return to the table several times to clean it. A handy wearable wipe unit would help them clean a table and by reattaching their wiper they could carry needed items.

Mechanics are often wiping grease and grime off their hands or equipment with rags. Looking for a rag is a daily occurrence and at times they put one in their pocket for convenience. This becomes a problem because the grease and grime then gets on their pants and pocket causing further sanitary problems. The versatility of having a wearable wiper unit would alleviate their complaints.

Hotel maids must clean a number of rooms in the course of a day. Using a wearable wiper unit with multiple layers would enable them to sanitize larger areas of the room without having to return to their cart as often to get more wipers.

My co-pending nonprovisional application, application Ser. No. 11/097,573, filed on Apr. 1, 2005, has solved these problems but I have found that the back side of the retaining member, when worn by a user and the user is engaged in physical activity and movement, the bottom end of the back side routinely presses into their bodies and causes discomfort. This problem has been solved with this improved unit and retaining member as set forth in this disclosure.

SUMMARY OF THE INVENTION

A wearable wipe unit having a retaining member with a front side, a top side, and a back side defining a mouth below the top side between the front side and back side; an adhesive component on the front side below the top side; and one or absorbent members with a base member removably attachable to and from the retaining member and one or more secondary units removably attachable from each other. The retaining member is wearable on a person's belt, waist band, or similar external object. One or more absorbent members may have a storage unit or pocket thereon adapted to hold one or more personal effects. The storage unit has a securing component adapted to secure the personal effects placed into the storage unit.

Accordingly, several objects and advantages of my wearable wipe unit are to:

a. establish an easy-to-use and readily-available wiping absorbent component for user's to wipe facilities, equipment, or themselves;

b. eliminate spread of contaminates on facilities or equipment;

c. provide a wiping absorbent component for repeated use as necessary, to be worn by a user, removed for use, and returned after use, readied for next use;

d. provide more than one wiping absorbent component for single use after which the used component may be discarded;

e. provide a convenient storage unit for personal items; and f. eliminate any discomfort to a user while wearing this unit and retaining member.

The foregoing has outlined some of the more pertinent objects of the wearable wipe unit. These objects should be construed to be merely illustrative of some of the more prominent features and applications of the intended wearable wipe unit. Many other beneficial results can be attained by applying the disclosed wearable wipe unit in a different manner or by modifying the wearable wipe within the scope of the disclosure. Accordingly, other objects and a fuller understanding of the wearable wipe may be had by referring to the summary of the wearable wipe unit and the detailed description of the preferred embodiment in addition to the scope of the wearable wipe unit defined by the claims taken in conjunction with the accompanying drawings.

BRIEF DESCRIPTION OF THE DRAWING FIGURES

Figure 6:
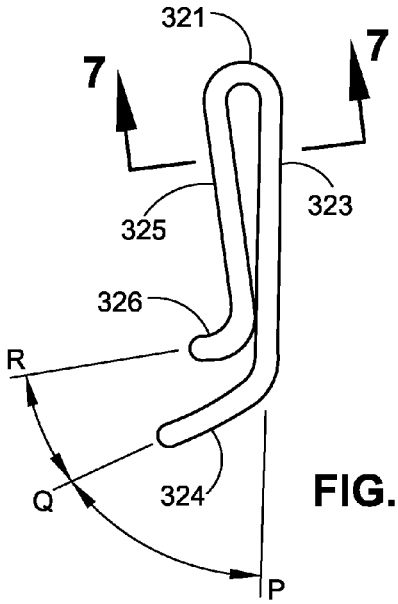
FIG. 6 is a side elevation view of the retaining member illustrated in FIG. 5.
Figure 7:
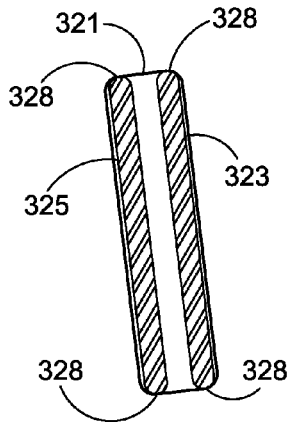

FIG. 7, as taken on line 7-7 of FIG. 6, is a cross-section view illustrating the curved side edges of the retaining member.

DESCRIPTION OF THE PREFERRED EMBODIMENTS

Figure 1:
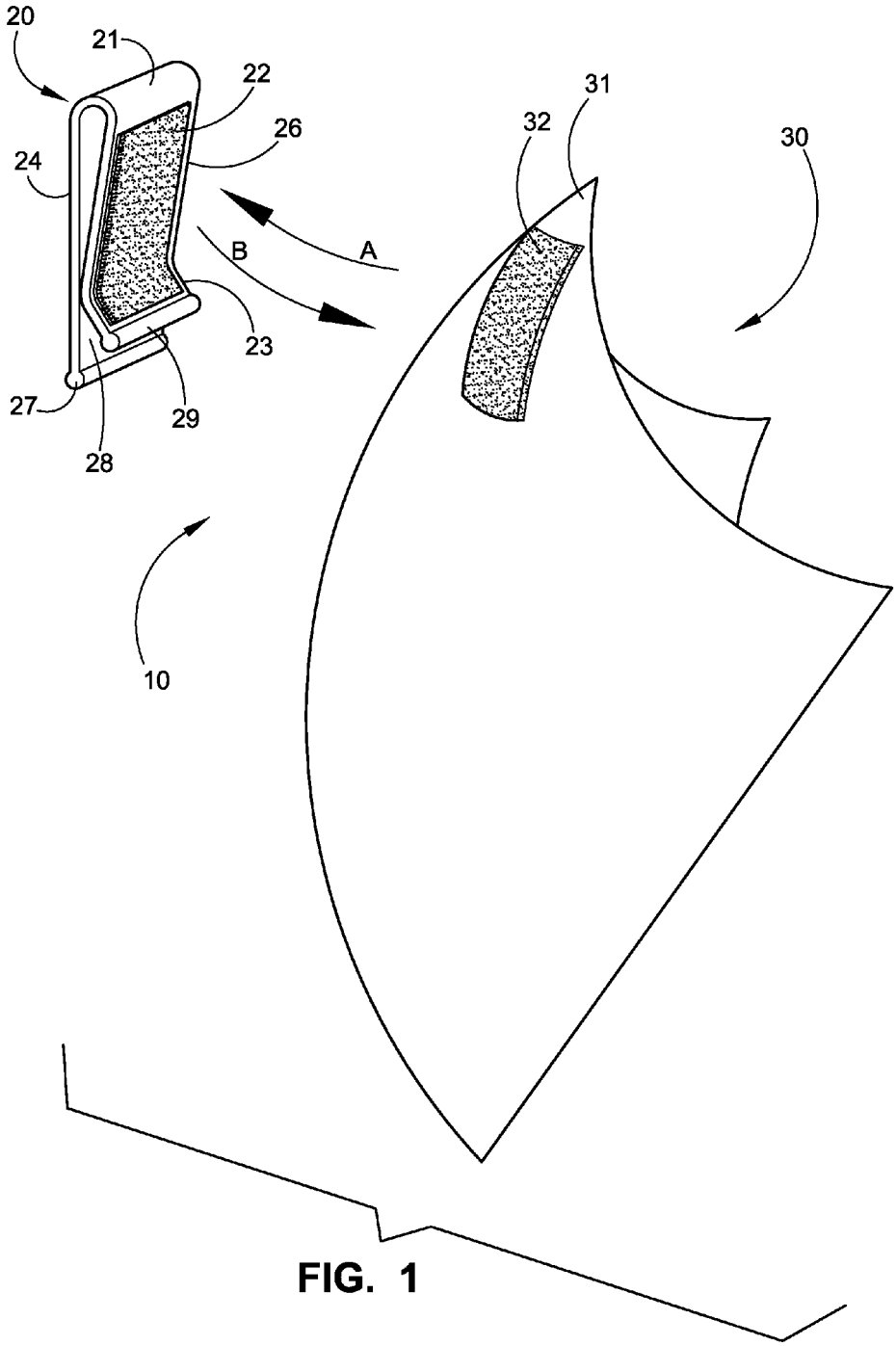
FIG. 1 is a perspective view of a preferred embodiment of the wipe unit.

Referring now to the drawings in detail and in particular to FIG. 1, reference character 10 represents the wipe unit which comprises a retaining member 20 and an absorbent member 30. The retaining member is generally a U-shaped clip-like structure having a back side 24, a top side 21, and a front side 26. A mouth 28 is defined below the top side 21 and in between the front side 26 and back side 24.

The retaining member 20 may be made of any material suited for the intended purpose, including, but not limited to, plastics, polymers, metals, and composites or any combinations thereof. The characteristic of the retaining member 20, for its intended function, is that the front side 26 or the back side 24 or both are biased toward the other or toward each other but are movable away from each other. The feature facilitates its function being inserted over and onto a belt, for example or the waist-band of a pair of pants or skirt and be held and worn thereat. Generally, the retaining member should be substantially rigid but have the biasing features set forth above.

Figure 2:
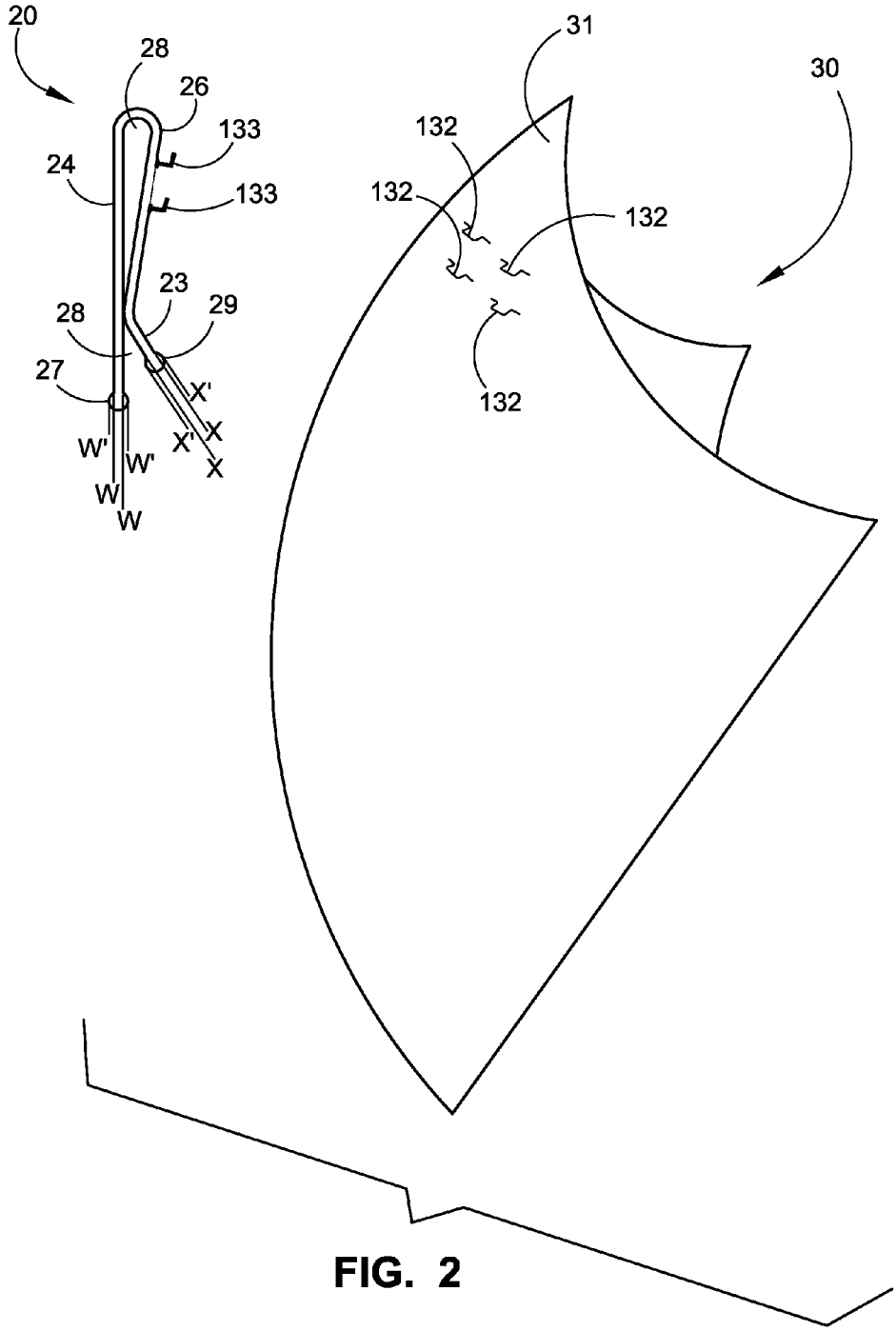
FIG. 2 is a side elevation view of one embodiment of the retaining member and wipe unit.
Figure 3:
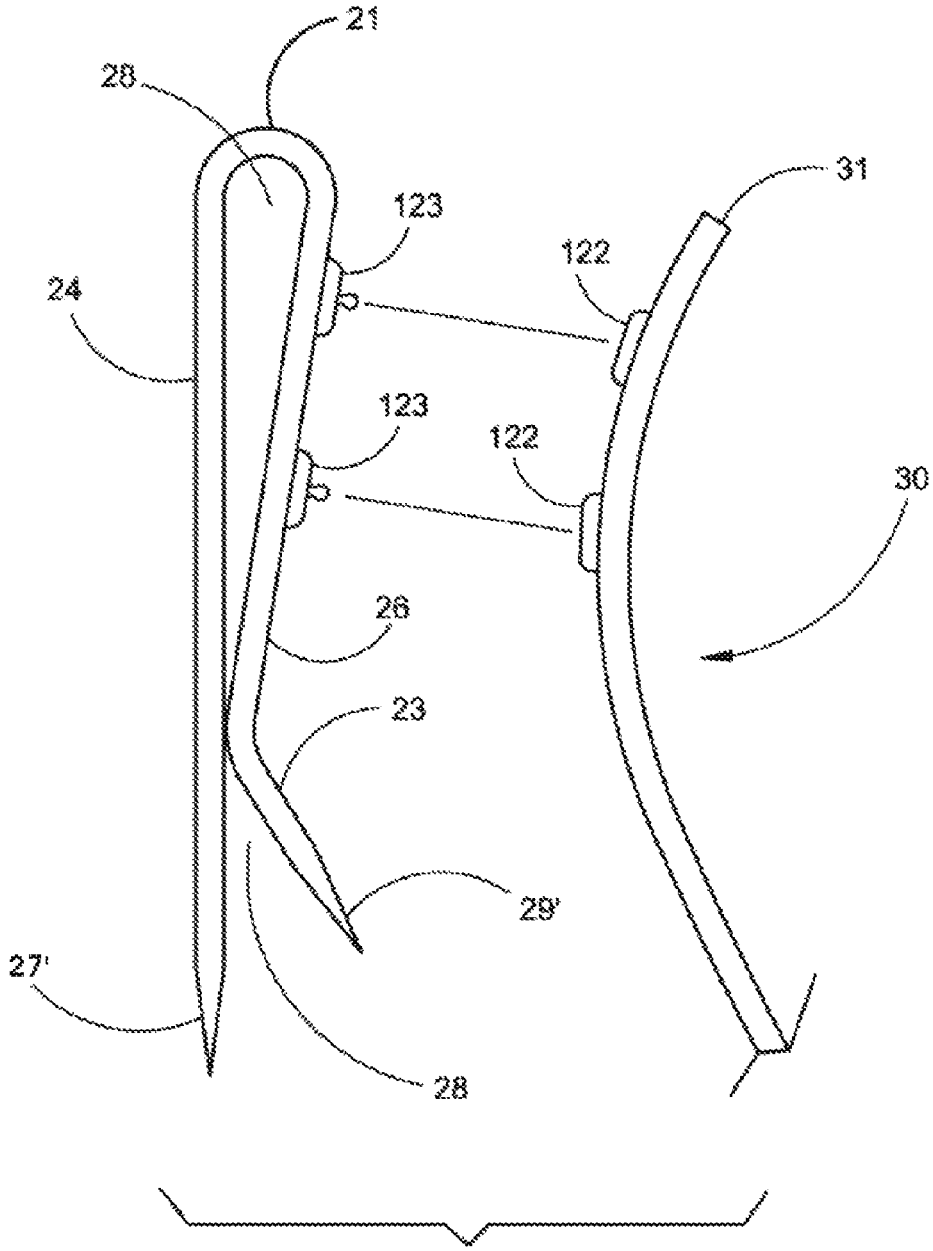
FIG. 3 is a side elevation view of a second embodiment of the retaining member and wipe unit.
Figure 4:
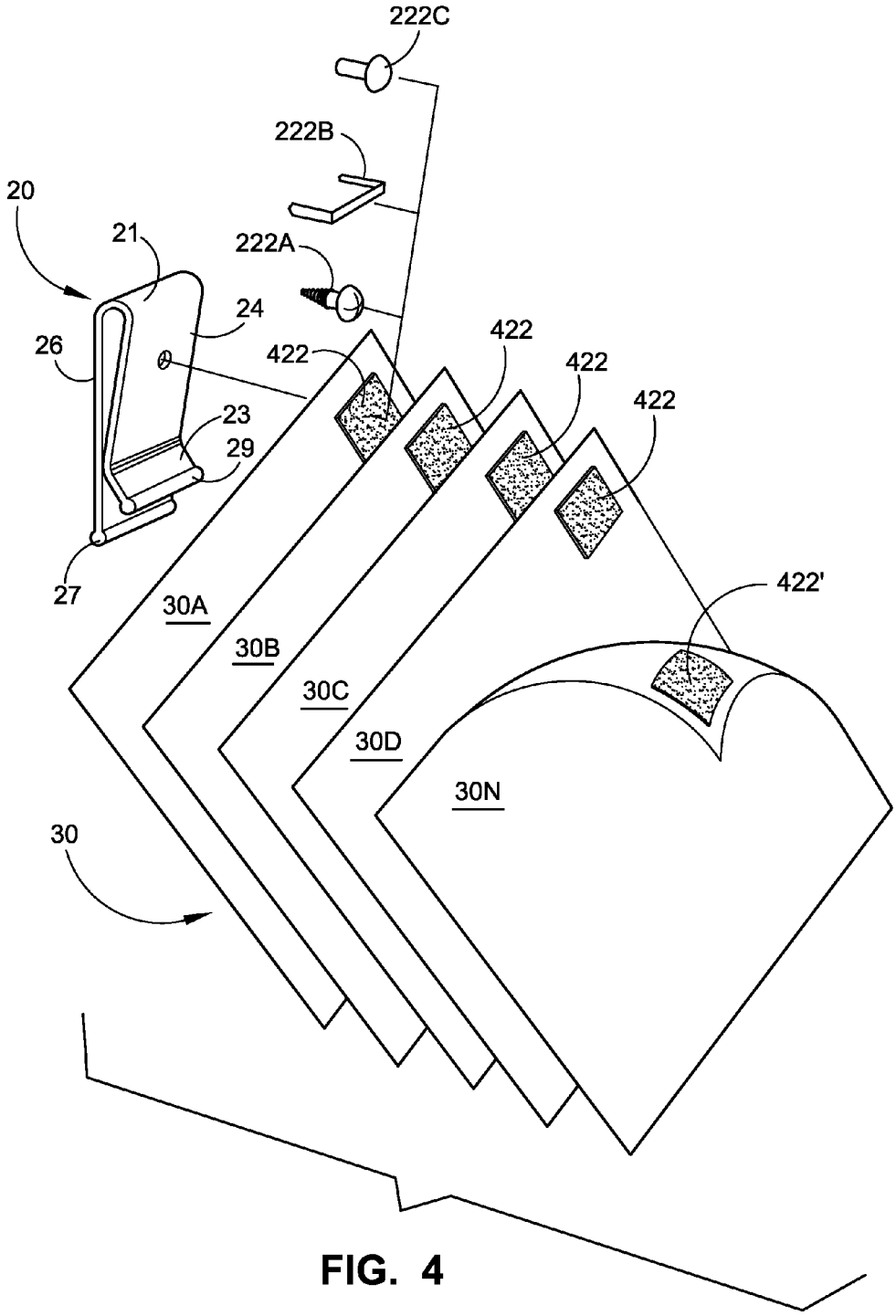
FIG. 4 is a perspective view of a second embodiment of the retaining member and wipe unit encompassing multiple wipes.

The bottom end of the back side 24 may be a rounded cylindrical end 27 or knob-like. This rounding running across the full or partial width of the bottom as illustrated in FIGS. 1, 2, and 4; or the bottom may be beveled or tapered 27' running across the full or partial width of the bottom as illustrated in FIG. 3. The bottom end of the front side 26 also may be a rounded cylindrical end 29 or knob-like, also running across the full or partial width of the bottom as illustrated in FIGS. 1, 2, and 4; or the bottom may be beveled or tapered 29' running across the full or partial width of the bottom as illustrated in FIG. 3.

Reference is made to FIG. 2. In the rounded embodiment, the thickness or diameter of the cylindrical ends 27, 29 is greater than the thickness of the respective sides 24, 26. In the regard, where the thickness of the front side 26 is X-X, the thickness or diameter of the cylindrical end 29 being X'-X', then X'-X' is greater than X-X; and where the thickness of the back side 24 is W-W, the thickness or diameter of the cylindrical end 27 being W'-W', then W'-W' is greater than W-W. In cross-section, the cylindrical structures 27, 29 are generally circular and have diameters W'-W', X'-X' which are greater than the thickness of the respective sides to which appended W-W, X-X.

The purpose of the rounding or tapering is to facilitate insertion of the retaining member 20 onto a belt, waist-band, or other generally planar object. The biasing toward each other of the front side 26 and the back side 24 more securely holds the retaining member 20 onto the object so placed.

At a point distal from the top side 21, the bottom section of the front side 26 may be angled outward; i.e., angled section 23. On the front side 26 is an adhesive component 22 the purpose of which is to accept, retain, and permit removal of an attached absorbent component 30 [hereafter for administrative convenience only, and not by way of limitation, referred to merely as wipe] which has a cooperating adhesive component 32 at or near the top 31 of the wipe 30. The respective adhesive component 22 and cooperating adhesive component 32 may be of the hook-and-loop type [commonly referred to as Velcro® and as illustrated in FIG. 1], may be of the hook-and-eye type 133, 132 as illustrated in FIG. 2], or may be of the male-female snap type 123, 122 [as illustrated in FIG. 3].

The wipe 30, with its cooperating adhesive component 32 thereon, may easily be attached to the adhesive component 22 on the retaining member 20. The wipe typically may be made from and of cotton, polyester, rayon, paper, nylon, wool, silk, or other natural or synthetic materials and any combinations thereof. If the retaining member 20 has been previously placed onto a person's belt or waist-band, the wipe 30 rests at the person's side ready for use. When needed, the person grabs the wipe 30, pulls it away from the retaining member 20 in any direction thereby releasing it from the retaining member 20. The person proceeds to using the wipe 30 as deemed necessary. After completion of use, the wipe 30 may be reattached to the retaining member 20. With this embodiment of the wipe unit, the wipe 30 may be used repeatedly as necessary.

The angled section 23 of the front side 26 serves to keep the wipe 30 relatively free of, and generally away from, the user thereby making the wipe 30 easier to grab when needed. The adhesive component 22 on the front side 26 may run the full length [height] of the front side 26 or may only run a portion thereof. The cooperating adhesive component 32 on the wipe 30 preferably is at the top 31 of the wipe 30, though it may encompass a greater surface than merely the top 31 or it may be located anywhere on the wipe 30.

Figure 5:
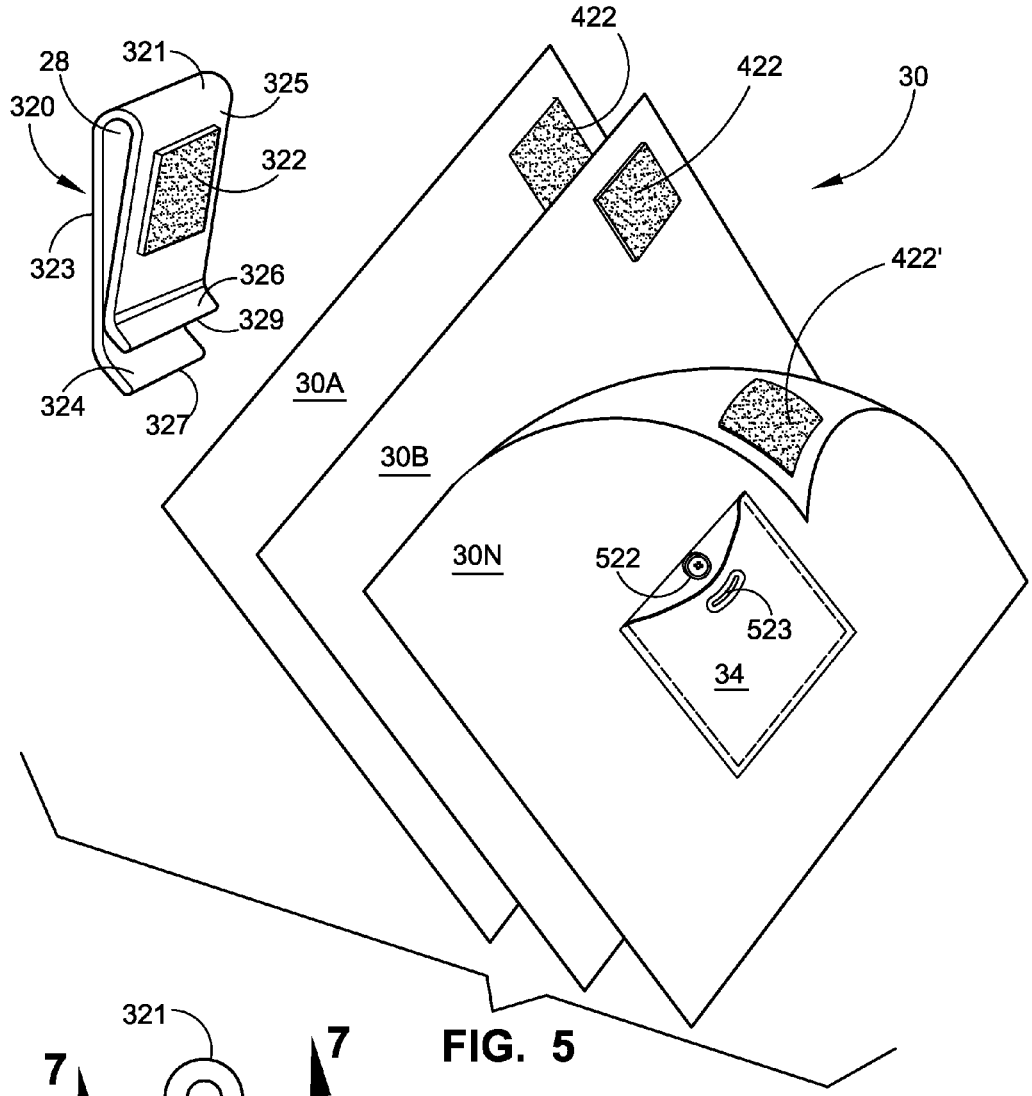
FIG. 5 is a perspective view of another embodiment of the retaining member and wipe unit encompassing multiple wipes.

The embodiment of the wipe unit described above and illustrated in FIG. 1 may also have one or more secondary absorbent members 30A-30N as illustrated in FIGS. 4 and 5. In this regard reference character 'A' represents one secondary absorbent member and reference character 'N' represents any number of secondary absorbent members [herein referred to as secondary wipes for administrative convenience and not by way of limitation]. The wipe 30, the base unit, is attachable to the retaining member 20 as described above. The base unit 30, will have hook-and-loop fasteners 22, 32 or an adhesive compound thereon, preferably at or near its top 31. Each successive secondary wipe 30A-30N, will also have corresponding hook-and-loop fasteners 22, 32 or an adhesive compound 422 on each side also at or near the top. This adhesive compound 422 should be such as to permit easy removal but also permit retention to each other when not removed. Removal of the secondary wipe commences with the outermost such wipe moving inward until the base wipe is removed. Each secondary wipe is generally disposable, consequently, re-attachment is neither desired nor necessary.

FIGS. 5 and 6 reflect also reflect a retaining component [or clip] 320 with rounded bottom ends 327, 329 which, however, are not cylindrical and generally are not greater in thickness than the thickness of the respective sides 323-324, 325-326 to which they form the end part. This most preferred embodiment is quite similar to the retaining component 20 previously described except that the bottom section 324 of the back side 323 is angled forward in similar fashion as the bottom section 326 of the front side 325.

As in the retaining component 20 previously described, the back side 323 and the front side 325 each project downward from the top 321 of this most preferred embodiment retaining component 320. A mouth 28 is immediately below the top 321. From the top 321, the front side 325 angles toward the back side 323 and biases thereto. This retaining component 320 is substantially rigid but its front and back sides 325, 323 are biasable toward and away from each other. Except for the forward angled bottom back section 324, the features and structure of this retaining component 320 are the same as described above and, by reference are incorporated herein.

This dual angling of the bottom section 324 of the back side 323 and bottom section 326 of the front side 325 adds a greater comfort level for the wearer. It has been found that the retaining component 20 with a straight back side 24 would routinely press against the user's body during movement. The angled bottom section 324 of the back side 323 alleviated this problem and the cause of discomfort.

FIG. 6 illustrates a representative preferred angling of these bottom section 324, 326 relative to the back side 323. With Angle-P as the zero reference point of the back side 323, the angling of the angled bottom section 324 of the back side 323 should range from approximately 40° to approximately 80° with an angle of approximately 65° being the optimum angle. The angling of the angled bottom section 326 of the front side 325 should range from approximately 55° to approximately 90° with an angle of approximately 80° being the optimum angle. This provides comfort to the wearer while also being able to easily slip onto a belt, shorts, or other suitable wearing apparel.

The outer side edges 328 of this retaining component 320 are curved as best illustrated in FIG. 7. Curving all the side edges provides a more comfortable fit to the wearer and eases excess pressure presented with more squared side edges.

The various adhesive compounds I have found to be suited for the intended purpose include those found in drying adhesives, reactive adhesives, cyanoacrylates, temporary adhesives, and hot adhesives and are briefly described below.

DRYING ADHESIVES. These are a mixture of ingredients (typically polymers) dissolved in a solvent. Glues and rubber cements are members of the drying adhesive family. As the solvent evaporates, the adhesive hardens. Depending on the chemical composition of the adhesive, they will adhere to different materials to greater or lesser degrees.

Typical brand names of such drying adhesives which I have found to perform this function adequately include, but are not limited to, Silicone II (made by GE Sealants and Adhesive) and E6000® (made by Eclectic Products, Inc.).

REACTIVE ADHESIVES. Epoxy resins are the most common example of this kind of adhesive. Reactive adhesives generally come in two separate containers. The two ingredients of the adhesive must be mixed in certain proportions immediately before application. Generally one ingredient is a monomer, or resin, and the second is a reaction initialiser. When the two are mixed together, a polymerization reaction occurs which solidifies the adhesive.

Reaction adhesives may also react with the surface of the materials to be stuck together. This is bonding, in which the adhesive forms chemical bonds with the material, and is distinct from sticking, the action of common glues. Typical brand names of such reactive adhesives which I have found to perform this function adequately include, but are not limited to, Extra Setting Time Epoxy (made by Super Glue Corp.) and Perfect Glue 3 (made by Macco, a division of ICI Paints).

CYANOACRYLATE. A special case of a reactive adhesive is cyanoacrylate (more commonly known by the brand name Super Glue®) which reacts with moisture in the air and therefore does not need any mixing before application. In its liquid form, cyanoacrylate consists of monomers of cyanoacrylate molecules, (C5H5NO2) CH2=C(CN)COOCH3, and has molecular weight equal to 111.1. Its burning point lies at 79° C. and its density is 1.1 times the density of common water (H2O).

It is an acrylic resin which rapidly polymerizes in the presence of water (specifically hydroxyl ions), forming long, strong chains, joining the bonded surfaces together.

Another important trait is that cyanoacryate sets up fast, often in less than a minute. A normal bond reaches full strength in two hours, and is waterproof. There are also accelerants that can force a set-up as fast as two or three seconds, at some loss of strength.

Reactive adhesives are very strong and are used for high-stress applications such as attaching wings to aircraft. Because the strength of a reactive adhesive is a result of chemical bonding with the surface material, reactive adhesives are applied in thin films. Reactive adhesives are less effective when there is a secondary goal of filling gaps between the surfaces. As a result, these can work well with the wipes for the purpose intended.

Typical brand names of such cyanoacryate adhesives I have found to perform this function adequately include, but are not limited to, Super Glue (made by Super Glue Corp.) and Loctite® Super Glue Gel (made by Henkel Consumer Adhesives, Inc.).

TEMPORARY ADHESIVES. Temporary adhesives are designed to repeatedly or easily stick and unstick. They have low adhesion and generally can not support much weight. They are commonly used on paper. They have common applications as bookmarks, informal notes and office supplies. Brands include Blu-Tack®, a gum-like adhesive, and the adhesive applied to the back of 3M's® Post-It® notes. Typical brand names of such drying adhesives which I have found to perform this function adequately include, but are not limited to, Craft Bond (made by Elmer's Products, Inc.) and Scotch® Craft Stick (made by 3M Corporation).

HOT ADHESIVES. Hot adhesives are adhesives which are applied hot and simply allowed to harden as they cool. These adhesives have become popular for crafts because of their ease of use and the wide range of common materials to which they can adhere and some are suitable for the intended purposes for the wearable wipe unit. Some hot adhesive brands which perform well for the intended purpose include, but are not limited to, Adhesive Tech™ Mini-sticks (made by Adhesive Technologies, Inc.) and Surebonder® All Purpose Stik™ (made by FPC Corp.).

Some brand names of drying adhesives, reactive adhesives, cyanoacryate adhesives, and hot adhesives I have found which are suited for this purpose of adhering a paper or cloth wipe to the retaining component include, but are not limited to, Gorilla Glue (made by Gorilla Glue Company) as a drying adhesive; Metal Epoxy (made by Super Glue Corp.) as a reactive adhesive; Super Glue (made by Super Glue Corp.) as a cyanoacrylate adhesive; Adhesive Tech™ Mini-sticks (made by Adhesive Technologies, Inc.) as a hot adhesive.

Other embodiments include those where the base unit wipe 30A is securely fastened to the retaining member 20 by any suited mechanical fastener, such as, but not limited to, one or more screws 222A, one or more rivets 222C, or one or more staples 222B, as illustrated in FIG. 4. The base unit wipe 30A also may be securely attached to the retaining member 20 by any suited chemical means, such as, but not limited to, adhesive components having high-adhesion qualities 322. Such adhesive components 322 include, but are not limited to, drying adhesives, reactive adhesives, cyanoacrylate adhesives, and hot adhesives as described above but with high-adhesion qualities.

Another feature of the wearable wipe unit 10 is a storage component 34 [herein for administrative convenience only and not by way of limitation referred to as 'pocket' ] into which the user may insert personal effects which may be needed by the user and should thereby be readily accessible. This 'pocket' 34 can be secured or closed by, but not limited to, hook-and-loop fasteners 22, 32, hook-and-eye fasteners 132, 133, snaps 122, 123, or buttons 522 with a suitable corresponding button hole 523 concealed or visible, or any combination of securing mechanisms herein mentioned [i.e., hook-and-loop, hook-and-eye, snaps, and button-button hole], with either securing mechanism all the way across the opening of the pocket 34 or on any section or portion thereof. The pocket 34 can be located anywhere on the absorbent material. As set forth above, the pocket 34 may be used for carrying small, lightweight items such as money, a car or house key, driver's license, gym card, and a fishing license.

The function of the pocket also is to permit a user to store external objects therein, to secure the pocket 34 in a closed position, to be able to open the pocket 34 to add or remove external objects, and to re-seal the pocket 34; i.e., return it to a sealed and secure or closed position thereby providing the pocket 34 with a releasable and resealable securing means.

Some specific examples of use may include the following:

a. Joggers find it cumbersome to carry their car key and driver's license in their shorts pocket when running because they dangle around. Many wear shorts that don't have pockets. Putting the key in the pocket of their wearable wiper unit would secure these items away from their body and allow them to choose any shorts to wear when jogging.

b. Waitresses and Bartenders can put their tips in the wiper pocket for fast and convenient storage.

c. Exercisers who come to the fitness facility without wanting to use a locker can store their gym card and money for a refreshment in the pocket 34 of their wearable wipe unit.

The wearable wipe unit is not limited to the embodiments described above but all changes and modifications thereto not constituting departures from the spirit and scope of the wearable wipe unit are intended to be included.

While the specific embodiments of the wearable wipe unit have been shown and fully explained above for the purpose of illustration, it should be understood that many other uses will be found for the instant disclosure and many alterations, modifications, and substitutions may be made thereto without departing from the spirit and scope of the wearable wipe unit as defined by the appended claims. Such are intended to be included within the scope of the wearable wipe unit.

What is claimed is:

1. A substantially rigid retaining member for use with one or more wearable wipe elements, said retaining member comprising:

(a) a top side portion;

(b) a back side portion wherein said back side portion extends downward from said top side portion and defines a terminal end distal to said top side, a mid-point there-along, and a first angle dividing an upper portion of said back side portion from a lower portion of said back side portion, said first angle being between forty degrees and eighty degrees relative to a plane defined by said upper portion of said back side portion; and (c) a front side portion wherein said front side portion extends downward from said top side in spaced relation to said back side, and angles biasedly toward said back side portion abutting said back side portion above said mid-point and therebelow angles away from said back side portion thereat defining an angled bottom section having a second angle said second angle being between fifty-five degrees and ninety degrees relative to the plane defined by said upper portion of said back side portion, the angled sections of both the back and front side portions extending from the same side of said plane and a front side portion terminal point wherein said front side portion further comprises an adhesive component between said second angle around to said top side portion, and wherein a U-shaped mouth is defined below said top side portion between said front side portion and said back side portion.

2. The retaining member as claimed in claim 1 wherein said adhesive component is one element of fasteners selected from the group consisting of hook-and-loop fasteners, female-male snap fasteners, and hook-and-eye fasteners.

3. The retaining member as claimed in claim 1 further having side edges on said back side said top side and said front side which are curved.

4. A wearable wipe assembly, comprising:

a retaining member clip for attaching said assembly to a person's clothing, said clip comprising:

a front side element defined by a distal section terminating in a distal end, a proximal section terminating in a proximal end, and a bend separating said distal section from said proximal section such that said distal section is aligned along a distal front side axis said proximal section defining a plane and said distal section extending at an angle to one side of the plane;

a back side element juxtaposed beneath said front said element, and defined by a distal section terminating in a distal end, a proximal section terminating in a proximal end, and a bend separating said distal section from said proximal section such that said distal section is aligned along a distal back side axis said back side element defining a plane;

a top side element interconnecting said proximal ends of said front and back side elements; and wherein said proximal section of said back side element is aligned along a proximal back side axis and said distal back side axis is at an angle of between forty degrees and eighty degrees towards said front side element relative to said proximal back side axis, and said distal front side axis is at an angle of between fifty-five degrees and ninety degrees away from said proximal back side axis relative to said proximal back side axis said distal back side axis and said distal front side axis extend in generally the same direction and to the same side of said pane relative to each other; and one or more wearable wipe element detachably attached to an outer face of said front side element.

5. The assembly of claim 4, wherein:

said angle between said distal back side axis and said proximal back side axis is approximately sixty-five degrees; and said angle between said distal front side axis and said proximal back side axis is approximately eighty degrees.

* * * * *